United States Patent [19]

Marzocco

[11] Patent Number: 5,068,990

[45] Date of Patent: Dec. 3, 1991

[54] TRIGGER MECHANISM FOR SMOOTH-BORE FIREARMS

[75] Inventor: Alessandro Marzocco, Milan, Italy

[73] Assignee: Luigi Franchi S.p.A., Italy

[21] Appl. No.: 602,528

[22] Filed: Oct. 24, 1990

[30] Foreign Application Priority Data

Oct. 27, 1989 [IT] Italy ..... 22182 A/89

[51] Int. Cl.[5] ..... F41A 17/56

[52] U.S. Cl. ..... 42/70.04

[58] Field of Search ..... 42/70.04, 70.05

[56] References Cited

U.S. PATENT DOCUMENTS

| | | | |
|---|---|---|---|
| 1,044,568 | 11/1912 | Pedersen | 42/70.04 |
| 2,233,504 | 3/1941 | Young | 42/70.04 |
| 2,296,447 | 3/1960 | Scripter | 42/70.05 |
| 2,856,718 | 10/1958 | Fischer | 42/70.05 |
| 3,949,508 | 4/1976 | Elkas | 42/70.05 |
| 4,719,841 | 1/1988 | Perrine | 42/70.04 |

*Primary Examiner*—Richard W. Wendtland

*Attorney, Agent, or Firm*—Diller, Ramik & Wight

[57] ABSTRACT

A safety device to prevent accidental firing acting on the engagement lever of the hammer in a trigger mechanism for smooth-bore firearms.

7 Claims, 3 Drawing Sheets

TRIGGER MECHANISM FOR SMOOTH-BORE FIREARMS

This invention relates to a trigger mechanism for smoothbore firearms of the type comprising a trigger, a release lever associated with the trigger, an engagement lever operated in rotation by the release lever opposing spring devices and having an engagement tooth, a hammer which moves angularly under the action of second spring devices from an armed position in which a counter-tooth on the hammer is engaged and held by the engagement tooth, to a firing position, as well as a safety device to prevent the hammer from accidentally abandoning the armed position.

As is well known, firearms must be prevented, as a result of being knocked or dropped, from accidentally firing a shot and for this purpose the trigger mechanisms have safety devices to prevent the hammer from reaching the firing position and striking the percussion pin.

Conventional safety devices are usually fitted on the trigger, so that they securely lock the trigger; in this condition the hammer, engaged by the tooth of the engagement lever, is held in the armed position. As a result of particularly strong knocks or play due to wear or weakening of spring elements, however, the counter-tooth of the hammer disengages itself from the engagement tooth, thus enabling the hammer to reach the firing position notwithstanding the trigger being locked.

A safety device that acts directly on the hammer is also proposed, so as to avoid the above-mentioned drawbacks. It was found, however, that with such devices the hammer is effectively locked in the armed position, but if for example due to a knock the engagement tooth disengages itself from the counter-tooth of the hammer becomes released immediately into the firing position, resulting in obvious drawbacks.

The problem that lies at the heart of this invention is to design a trigger mechanism which has structural and operating characteristics such as to overcome the drawbacks mentioned as regards the known state of the art.

This problem is resolved according to the invention by a trigger mechanism characterised in that the said safety device comprises a positive stop fitted removably at the said engagement lever to prevent rotation of the latter.

The characteristics and advantages of a trigger mechanism according to the present invention will emerge from the following description of a preferred embodiment, given by way of example and not limited by the attached drawings.

Figure 1:
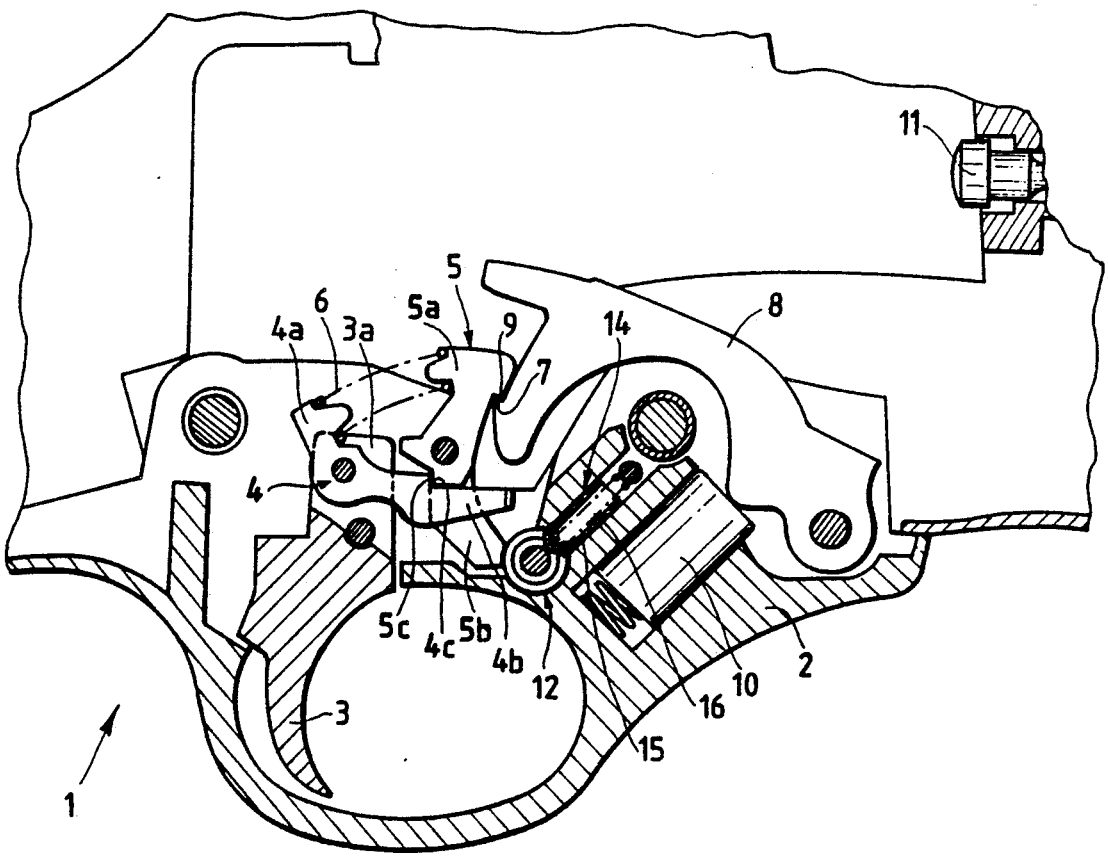
FIG. 1 is a side, schematic cross-sectional view of a trigger mechanism of a smooth-bore firearm according to the invention.
Figure 2:
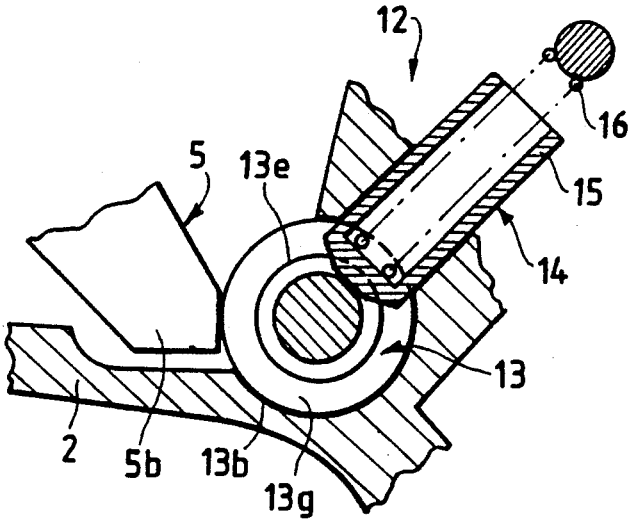
FIG. 2 is an enlarged scale view of a detail of the mechanism shown in FIG. 1.
Figure 3:
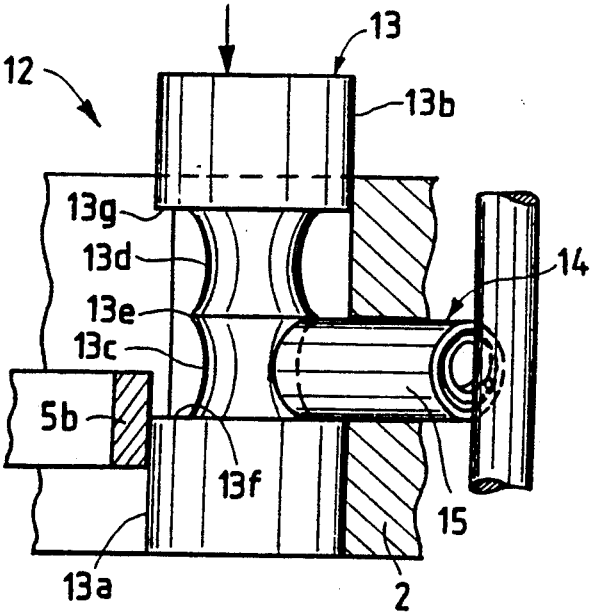
FIGS. 3 and 4 are plan, schematic and partly cutaway view of the above-mentioned detail of the trigger mechanism in different operating conditions.
Figure 4:
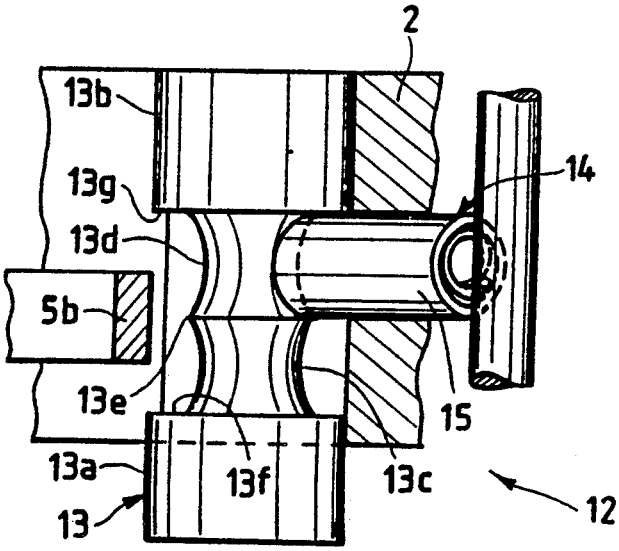

With reference to the above-mentioned Figures, 1 shows a trigger mechanism a a whole according to the invention for a smooth-bore firearm. The example under consideration refers in particular to a 20-caliber semi-automatic rifle.

The trigger mechanism 1 comprises a supporting body 2 in which pivots a trigger 3. At one end 3*a* of the trigger 3 pivots a release lever 4 with a first arm 4*a* and a second arm 4*b*, defining with the first arm an angle of approximately 120°, in which is formed a ledge 4*c*. Trigger mechanism 1 comprises an engagement lever 5 pivoted in body 2 and operated in rotation by release lever 4 opposing first spring devices 6, as will emerge from the rest of the description.

Engagement lever 5 has a first end 5*a* with an engagement tooth 7 in the opposite part to the release lever 4, as well as an opposing second end 5*b* in which is formed a counterledge 5*c*.

The said first spring devices 6 are fitted between the first arm 4*a* of the release lever 4 and the first end 5*a* of lever 5, and act constantly to press the ledge 4*c* against the counter-ledge 5*c*.

A hammer 8 is, also pivoted in body 2. It will be observed that the axes of rotation of hammer 8, engagement lever 5 and release lever 4, as well as trigger 3 are parallel to each other and extend transversely across body 2.

Hammer 8 has a counter-tooth 9 and is angularly movable under the action of the second spring devices 10, fitted between body 2 and hammer 8, from an armed position in which the counter-tooth 9 is engaged and held by engagement tooth 7, to a firing position in which hammer 8, disengaged from tooth 7, strikes percussion pin 11 of the firearm.

Trigger mechanism 1 also comprises a safety device 12 to prevent accidental firing, which is in particular designed to prevent hammer 8 from accidentally abandoning the above-mentioned armed position.

Device 12 comprises a pin 13 extending transversely as described above, fitted in body 2 in close proximity to engagement lever 5 and sliding between a first position, locking position, and a second position, firing-enable position.

In particular, pin 13 has two cylindrical sections 13*a* and 13*b* and two annular adjacent grooves 13*c* and 13*d*, formed circumferentially between the said cylindrical sections 13*a* and 13*b* .

Furthermore, there is an annular projection 13*e* between grooves 13*c* and 13*d*, while there are shoulders 13*f* and 13*g* between cylindrical section 13*a* and groove 13*c* and between groove 13*d* and cylindrical section 13*b* .

It will be noted that, when pin 13 is in the first locking position, the cylindrical section 13*a* interferes with the trajectory of the second end 5*b* and constitutes a positive stop to prevent the rotation of engagement lever 5.

Furthermore, pin 13 is shaped so that in the said first position the opposite cylindrical section 13*b* protrudes beyond body 2.

In the second firing-enable position, pin 13 is positioned with groove 13*c* at end 5*b*, so as not to interfere with engagement lever 5. In this second position cylindrical section 13*a* protrudes beyond body 2.

Safety device 12 has additional stop devices 14, cooperating with the grooves 13*c* and 13*d* and with the shoulders 13*f* and 13*g*, to hold pin 13 in the first or second position. These stop devices preferably comprise a pawl 15 with respective spring devices 16, fitted in body 2 and capable of clicking removably into one or other groove 13*c*, 13*d*.

There follows a description of the operation of the trigger mechanism 1 according to the present invention.

Hammer 8 is brought to the armed position in a manner which in itself is conventional, for example by pulling back a breech-block on the firearm, not shown.

In the arm position, counter-tooth 9 of hammer 8 is engaged with tooth 7 of engagement lever 5 and held in the armed position by the action of the first spring devices 6.

In this condition and with pin 13 in the second position, or fire-enable position, with cylindrical section 13*a* protruding beyond body 2 and groove 13*c* at end 5*b* of engagement lever 5, acting on trigger 3, release lever 4, associated with the trigger, causes engagement lever 5 to rotate so as to disengage counter-tooth 9 and release hammer 8 into the firing position.

With pin 13 in the first position, or locking position, with cylindrical section 13*a* interfering with end 5, engagement lever 5 is prevented from rotating and consequently countertooth 9 of hammer 8 is prevented from disengaging from engagement tooth 7.

It is important to stress that with pin 13 in the locking position neither accidental knocks nor the operation of trigger 3 can cause hammer 8 to abandon the armed position.

Furthermore, it should be noted that in order to bring pin 13 into the first or second position it is sufficient to press one or other of cylindrical sections 13*a* and 13*b* so that sprung pawl 15 overcomes projection 13*e* and positions itself in the desired groove 13*c* or 13*d*.

Figure 5:
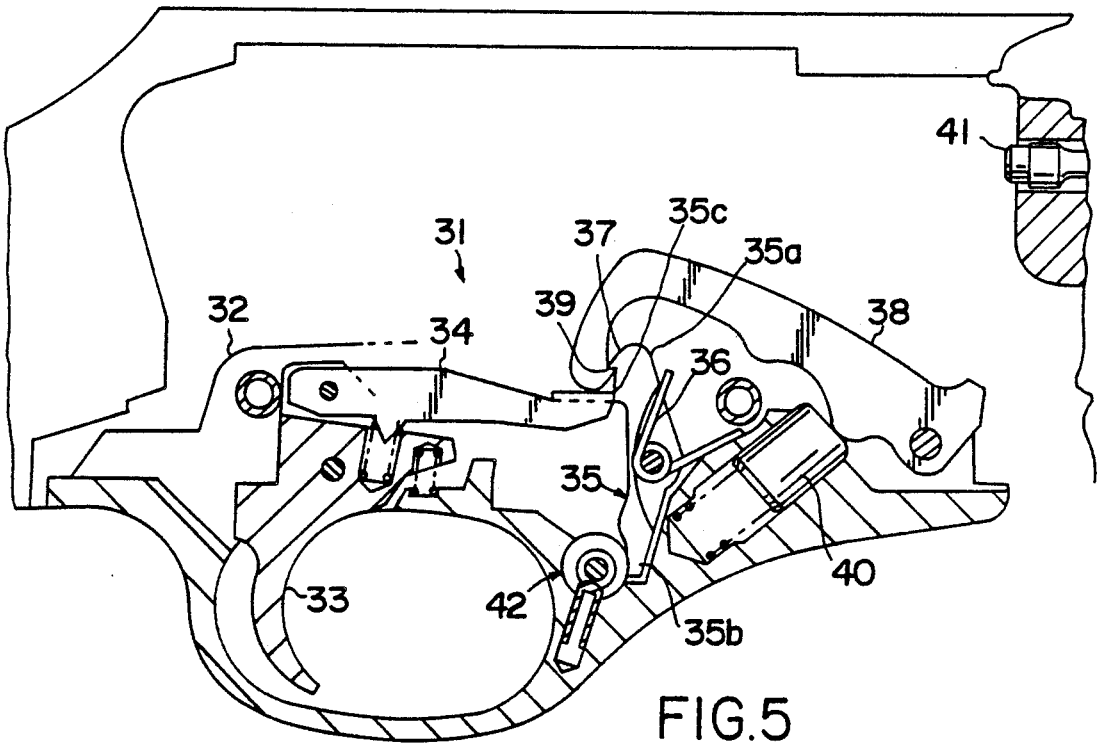
FIGS. 5 and 6 are side, schematic cross sectional view of another embodiment of a trigger mechanism according to the present invention.
Figure 6:
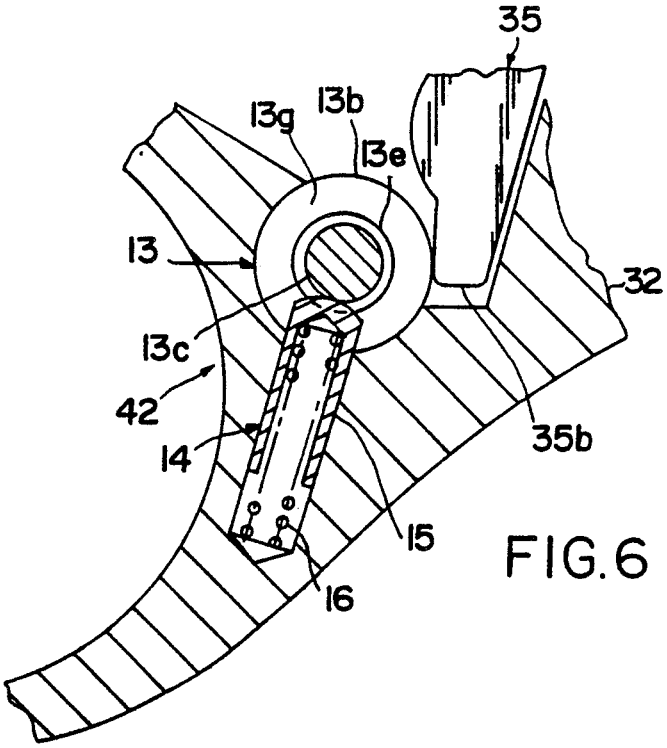

FIGS. 5 and 6 show another embodiment of a trigger mechanism according to the invention, intended for 12-caliber semi-automatic rifle of the smooth-bore type.

Such a trigger mechanism is indicated as a whole with the reference number 31 and comprises, fitted on a supporting body 32, a trigger 33, a sprung release lever 34 cooperating with the trigger 33, an engagement lever 35 centrally pivoted in body 32 and rotationally operated by the release lever 34 counteracting with spring devices 36.

The engagement lever 35 defines a first end 35*a*, provided with an engagement tooth 37 oriented toward the release lever 34, and a second end 35*b* opposite to the first one.

Close to tooth 37, a ledge 35*c* is formed on the engagement lever 35 and it is constantly urged by spring devices 36 toward an end of the release lever 34.

A hammer 38, pivoted in body 32 and provided with a counter-tooth 39, is angularly movable upon the action of relative spring means 40 from an armed position in which the counter-tooth 39 is engaged and held by the engaging tooth 37, to a firing position in which the hammer 38 strikes a pin 41 of the firearm.

Reference number 42 indicates a safety device, intended for preventing accidental firing, acting on second end 35*b* of engagement lever 35 in order to prevent the rotation of this latter and consequently preventing the hammer 38 from abandoning its armed position.

The safety device 42 is completely equivalent to the safety device 12 herein described with reference to FIGS. 1 to 4; therefore the components of device 42 will be indicated in the figures with the same reference number as those used for safety device 12 and will not be re-described.

Furthermore the actuation of the safety device 42 as well as the actuation of the trigger mechanism 31 are to be considered analogous to those of safety device 12 and trigger mechanism 1.

The trigger mechanism according to the present invention prevents the risk of accidental firing, however hard the firearm may be knocked. Furthermore, the safety device of the trigger mechanism may be operated manually, simply and quickly, and, due to its advanced position in respect to the trigger may be equally used by both right and left handed.

Clearly, numerous variations and modifications may be made to the trigger mechanism previously described, all of which fall are covered by the present invention as defined in the following claims.

I claim:

1. A trigger mechanism for smooth-bore firearms comprising a trigger (3, 33), first pivot means, mounting said trigger for pivoting movement, a release lever (4, 34), second pivot means mounting said release lever for pivoting movement, an engagement lever (5, 35), third pivot means mounting said engagement lever for pivoting movement, a hammer (8, 38), fourth pivot means mounting said hammer for pivoting movement, said engagement lever (5, 35) having opposite ends (5*a*, 35*a*: 5*b*, 35*b*), a first (5*a*, 35*a*) of said engagement lever opposite ends having a tooth (7, 37) in engagement with a counter tooth (9, 39) of said hammer in the armed position thereof, and safety means (12) operative in a first position for engaging a second (5*b*, 35*b*) of said engagement lever opposite ends to prevent rotation of said engagement lever (5, 35) in a direction to release the engagement between said tooth (7, 37) and counter tooth (9, 39) and being further operative in a second position for disengaging said second engagement lever opposite end (5*b*, 35*b*) to permit rotation of said engagement lever (5, 35) in a direction to release the engagement between said tooth (7, 37) and counter tooth (9, 39).

2. A trigger mechanism as defined in claim 1 including spring means (6, 36) for biasing said engagement lever (5, 35) and hammer (8, 38) relative to each other in a direction for maintaining said tooth (7, 37) and counter tooth (9, 39) in engagement with each other in the armed position thereof.

3. The trigger mechanism as defined in claim 1 wherein said first through fourth pivot means have axes in generally parallel relationship to each other, and said safety means (12) includes a pin (13) reciprocally slidable in parallel relationship to said first through fourth pivot means axes.

4. The trigger mechanism as defined in claim 1 wherein said release lever (4, 34) and said engagement lever (5, 35) have respective ledges (4*c*, 34*c*: 5*c*, 35*c*) in engagement with each other in the first position of said safety means (12).

5. A trigger mechanism as defined in claim 4 including spring means (6, 36) for biasing said engagement lever (5, 35) and hammer (8, 38) relative to each other in a direction for maintaining said tooth (7, 37) and counter tooth (9, 39) in engagement with each other in the armed position thereof.

6. The trigger mechanism as defined in claim 5 wherein said first through fourth pivot means have axes in generally parallel relationship to each other, and said safety means (12) includes a pin (13) reciprocally slidable in parallel relationship to said first through fourth pivot means axes.

7. The trigger mechanism as defined in claim 4 wherein said first through fourth pivot means have axes in generally parallel relationship to each other, and said safety means (12) includes a pin (13) reciprocally slidable in parallel relationship to said first through fourth pivot means axes.

* * * * *